US006679209B2

(12) United States Patent
Hibi et al.

(10) Patent No.: US 6,679,209 B2
(45) Date of Patent: Jan. 20, 2004

(54) VALVE TIMING CONTROL APPARATUS FOR INTERNAL COMBUSTION ENGINE

(75) Inventors: Tsutomu Hibi, Kanagawa (JP); Naotaka Nakura, Kanagawa (JP)

(73) Assignee: Hitachi Unisia Automotove, Ltd., Atsugi (JP)

( * ) Notice: Subject to any disclaimer, the term of this patent is extended or adjusted under 35 U.S.C. 154(b) by 0 days.

(21) Appl. No.: 10/267,678

(22) Filed: Oct. 10, 2002

(65) Prior Publication Data

US 2003/0070640 A1 Apr. 17, 2003

(30) Foreign Application Priority Data

Oct. 11, 2001 (JP) ..... 2001-313368

(51) Int. Cl.[7] ..... F01L 1/34

(52) U.S. Cl. ..... 123/90.17; 123/90.15; 123/90.31

(58) Field of Search ..... 123/90.17, 90.31, 123/90.15

(56) References Cited

U.S. PATENT DOCUMENTS 6,502,537 B2 * 1/2003 Todo et al. ..... 123/90.17
6,510,826 B2 * 1/2003 Watanabe ..... 123/90.17
6,561,149 B1 * 5/2003 Kobayashi et al. ..... 123/90.17
6,622,674 B2 * 9/2003 Kobayashi et al. ..... 123/90.15

FOREIGN PATENT DOCUMENTS

JP 2001-041013 A 2/2001

OTHER PUBLICATIONS

U.S. patent application Ser. No. 10/267,864, Todo et al., filed Oct. 10, 2002.
U.S. patent application Ser. No. 10/267,776, Watanabe et al., filed Oct. 10, 2002.
U.S. patent application Ser. No. 10/267,866, Watanabe et al., filed Oct. 10, 2002.

* cited by examiner

*Primary Examiner*—Thomas Denion
*Assistant Examiner*—Zelalem Eshete
(74) *Attorney, Agent, or Firm*—Foley & Lardner

(57) ABSTRACT

A valve timing control apparatus is provided which comprises an intermediate rotary member rotatable relative to a driving rotary member and a driven rotary member and having a spiral guide of a single spiral. Rotation of the intermediate rotary member caused by a control force applying unit causes radial movement of the guided members which is in turn converted to relative rotation between the driving rotary member and the driven rotary member by the links. The spiral of the spiral guide is defined so that a rate of change of spiral radius per angle is not constant.

14 Claims, 13 Drawing Sheets

VALVE TIMING CONTROL APPARATUS FOR INTERNAL COMBUSTION ENGINE

BACKGROUND OF THE INVENTION

The present invention relates to a valve timing control apparatus for variably controlling an opening and closing timing of an intake valve and/or an exhaust valve of an internal combustion engine in accordance with an operating condition of the engine.

A valve timing control apparatus of this kind is adapted to control the opening and closing timing of an engine valve through control of a relative phase between a crankshaft and a camshaft. That is, the apparatus of this kind includes a driving rotary member drivingly connected by way of a timing chain or the like to the crankshaft and rotatable relative to a driven rotary member on the camshaft side. Between the driving and driven rotary members is interposed a phase control mechanism for variably controlling the relative phase therebetween.

There have been developed various phase control mechanisms such as one that uses a helical gear for converting axial motion of a hydraulic piston to rotational motions of the rotary members. Recently, it has been proposed a phase control mechanism of the kind that uses links and has many advantages such as a reduced axial length and a smaller friction loss.

SUMMARY OF THE INVENTION

A valve timing control apparatus having a phase control mechanism using links is encountered by a problem that it has a difficulty in obtaining desired performance characteristics since it utilizes a spiral guide of an Archimedes spiral.

It is an object of the present invention to provide a valve timing control apparatus for an internal combustion engine that can make higher the design freedom of links and other parts that are engaged with a spiral guide and can improve the performance characteristics that are related to the spiral of the spiral guide.

To achieve the above object, the present invention provides a valve timing control apparatus for an internal combustion engine comprising a driving rotary member drivingly connected to a crankshaft, a driven rotary member drivingly connected to a camshaft, a plurality of radial guides provided to one of the driving rotary member and the driven rotary member, an intermediate rotary member rotatable relative to the driving rotary member and the driven rotary member and having at a side thereof a spiral guide of a single spiral, a plurality of guided members movably engaged with the respective radial guides and the spiral guide, a plurality of links connecting between the other of the driving rotary member and the driven rotary member and the respective guided members, a control force applying unit for applying to the intermediate rotary member a control force for rotating the intermediate rotary member to rotate relative to the driving rotary member and the driven rotary member, wherein rotation of the intermediate rotary member caused by the control force applying unit causes radial movement of the guided members which is in turn converted to relative rotation between the driving rotary member and the driven rotary member by the links, and wherein the spiral of the spiral guide is defined so that a variation rate of spiral radius per angle is not constant.

The other objects and features of this invention will become understood from the following description with reference to the accompanying drawings.

DESCRIPTION OF THE PREFERRED EMBODIMENTS

For better understanding of the present invention, description is first made as to an example of a valve timing control apparatus related to the present invention. Such an apparatus is disclosed in Unexamined Japanese Patent Publication No. 2001-41013 and also shown in FIGS. 15 and 16.

Figure 15:
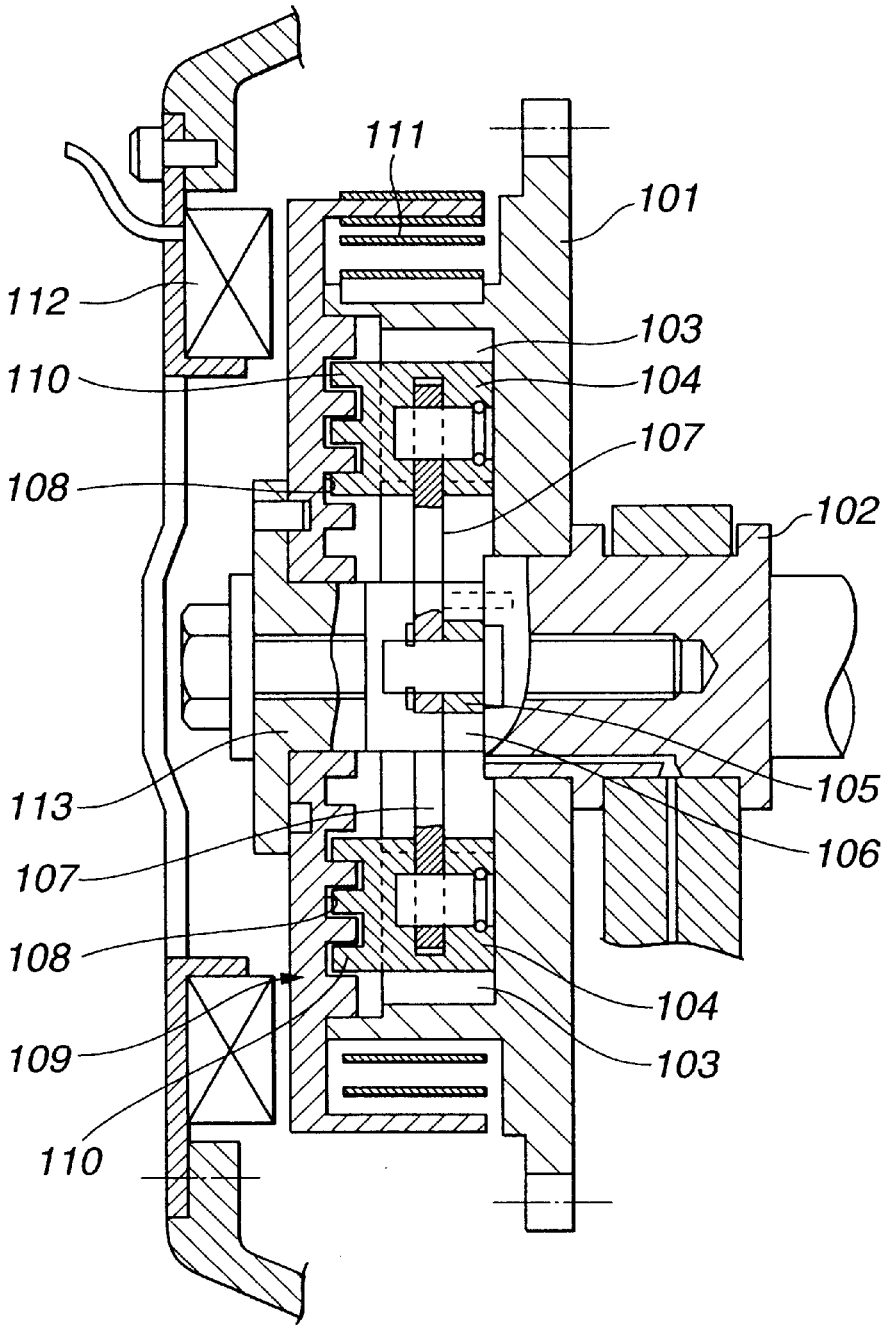
FIG. 15 is a sectional view of an example of a valve timing control apparatus relating to the present invention.
Figure 16:
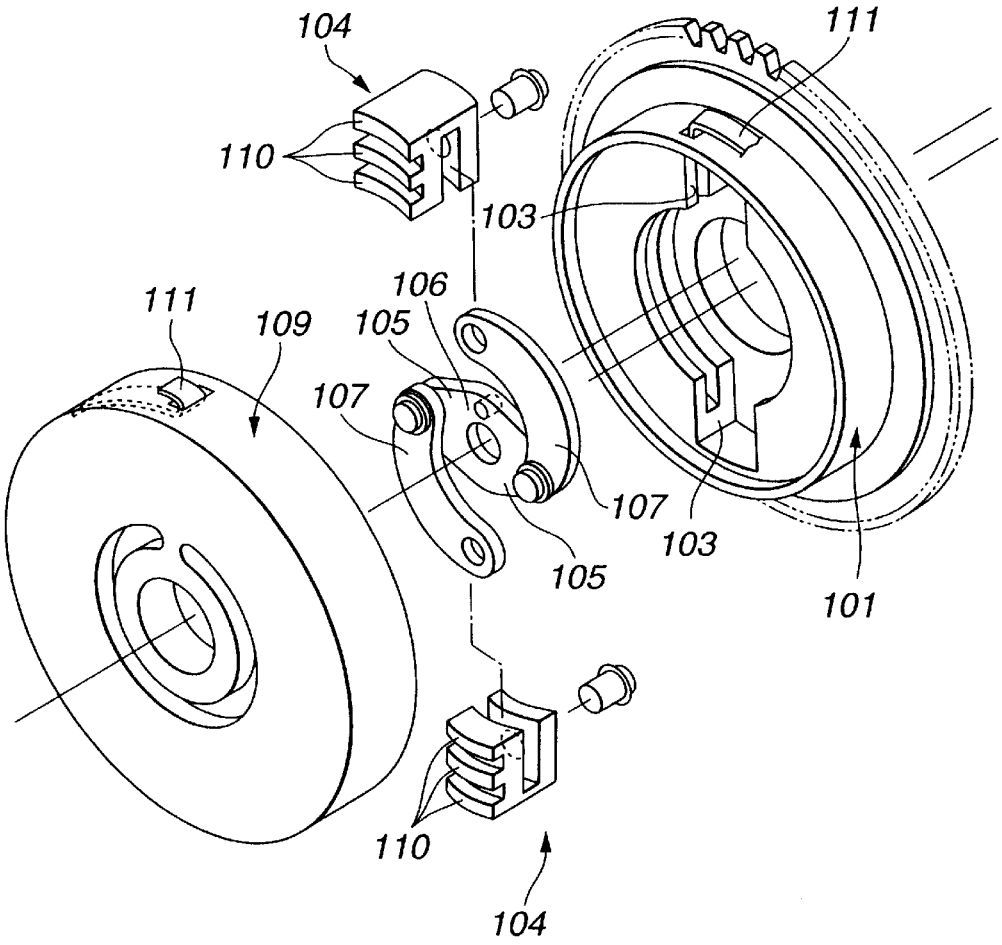
FIG. 16 is a perspective view of the apparatus of FIG. 15, with some parts being omitted.

Referring to FIGS. 15 and 16, indicated by 101 is a housing (driving rotary member) drivingly connected to a crankshaft (not shown) by way of a timing chain (also not shown). Housing 101 is rotatably mounted on an end portion of camshaft 102. At the inner side of housing 101 are formed radial guides 103 in which guided members 104 are radially movably disposed. Lever shaft 106 (driven rotary member) having diametrically opposed levers 105 is fixedly attached to an end of camshaft 102. Levers 105 are pivotally connected to guided members 104 by way of links 107, respectively. At the position opposed to radial guides 103 of housing 101 is disposed intermediate rotary member 109 that has single spiral guide 108 at the radial guide 103 side and is rotatable relative to housing 101 and lever shaft 106. Each guided member 104 has at an axial end a plurality of nearly circular arc-shaped projections 110 that are engaged with spiral guide 108 and movably guided thereby. Further, intermediate rotary member 109 is urged by spiral spring 111 in the direction to advance rotation thereof relative to housing 101 and adapted to receive from electromagnetic brake 112 a force in the direction to retard rotation thereof.

With this apparatus, when electromagnetic brake 112 is OFF, intermediate rotary member 109 is placed in the initial position relative to housing 101 under the bias of spiral spring 111 and guided members 104, 104 that engage at projections 110 with spiral guide 108 are moved radially outward maximumly thereby pulling links 107 so as to hold the relative phase between housing 101 and camshaft 102 in a maximumly retarded or advanced condition (i.e., in a condition where the valve timing is maximumly retarded or advanced). When, under this condition, electromagnetic brake 112 is turned ON, intermediate rotary member 109 is decreased in the rotation speed and thereby rotated relative to housing 101 toward the retard side. As a result, guided members 104 engaged with spiral guide 108 are caused to move radially inward and push links 107 having been pulled so far, thus allowing the relative phase between housing 101 and camshaft 102 to be varied toward a maximumly advanced or retarded condition.

In such a valve timing control apparatus, spiral guide 108 is formed in the shape of an Archimedes' spiral that is a spiral curved where a variation rate of spiral radius per angle is constant. Due to this, the relative phase between the driving rotary member (lever 106) and the driven rotary member (camshaft 102) that is varied in response to rotation of intermediate rotary member 109 has such a non-linear variation characteristic as represented by the dotted-line curve in FIG. 7. Such a non-linear variation characteristic causes obstacles to design of parts engaged with spiral guide 108 and improvement in the performance characteristic of the apparatus.

For example, links 107 engaged with spiral guide 108 must be designed separately so as to have different lengths so that guided members 104 engaged with spiral guide 108 are movable synchronously with each other. This largely restricts the design freedom of links 107 and other parts engaged with spiral guide 108 and therefore forces difficult designs upon developers. Further, when an effort was made for improving the performance characteristic of intermediate rotary member 109 at the time of returning to the initial position, a desired characteristic cannot be attained due to the restriction of the above-described non-linear variation characteristic.

Referring now to FIGS. 1 to 11, a valve timing control apparatus according to a first embodiment of the present invention will be described. In this embodiment, the valve timing control apparatus of this invention is applied to an intake side drive system of an internal combustion engine but can also be applied to an exhaust side drive system.

Figure 1:
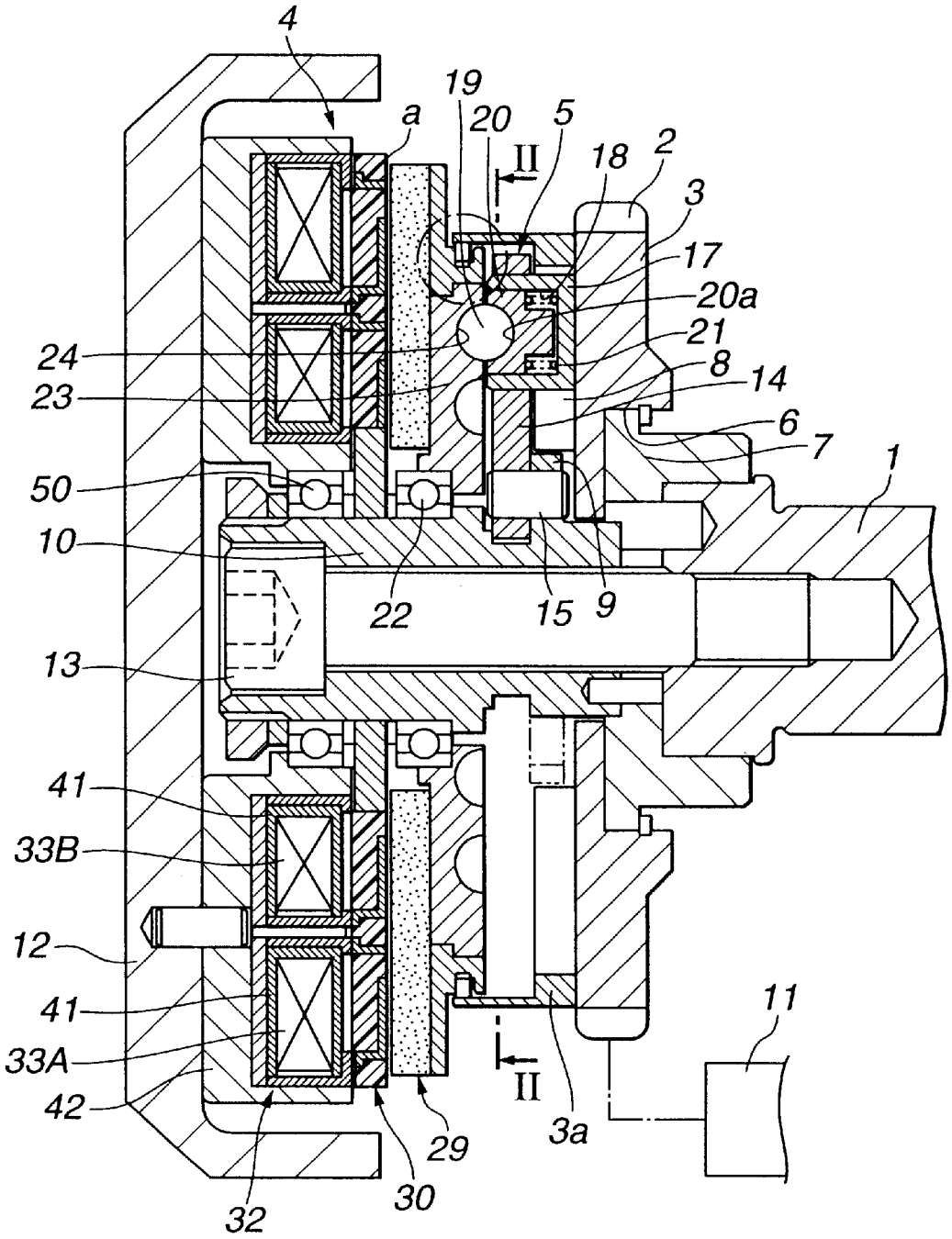
FIG. 1 is a longitudinal sectional view of a valve timing control apparatus according to an embodiment of the present invention.

As shown in FIG. 1, the valve timing control apparatus includes camshaft 1 rotatably supported on a cylinder head (not shown) of an internal combustion engine, drive plate (driving rotary member) 3 rotatably mounted on a front end portion of camshaft 1 and having at an outer circumferential periphery timing sprocket portion 2 that is drivingly connected by way of a chain (not shown) to crankshaft 11, phase control mechanism 5 disposed forward (leftward in FIG. 1) of drive plate 3 and camshaft 1 for controlling the relative phase between drive plate 3 and camshaft 1, control force applying unit 4 disposed forward of phase control mechanism 5 for applying a control force to phase control mechanism 5 thereby controlling the operation of same, and cover 12 disposed at the front of a cylinder head (not shown) and a rocker cover (not shown) so as to cover the front of phase control mechanism 5 and control force applying unit 4.

Drive plate 3 is in the form of a disk and has at a central portion thereof stepped hole 6. At stepped hole 6, drive plate 3 is rotatably supported on flange ring 7 that is integrally connected to a front end of camshaft 1. At the front side (the side opposite to camshaft 1), drive plate 3 has three radial grooves (radial guides) 8 in which base portions of guided members 17 that are square in section are slidably or movably disposed. Such radial grooves 8 are defined by annular member 3*a* fixedly attached to the front side of drive plate 3 or alternately to lever shaft 10. Namely, radial guide 8 may be provided to either of the driving rotary member (drive plate 3) or the driven rotary member (lever shaft 10). When, however, radial guide 8 is provided to the driven rotary member (lever shaft 10), each lever 9 is pivotally connected to the driving rotary member (drive plate 3).

Further, on the forward side of flange ring 7 is disposed lever shaft (driven rotary member) 10 having three levers 9. Lever shaft 10 is connected together with flange ring 7 to camshaft 1 with bolt 13. On each lever 9 of lever shaft 10 is pivotally supported an end of link 14 by means of pin 15. On the other end of each link 14 is rotatably fitted each guided member 17 that is engaged at the base portion with radial groove 8.

Since each guided member 17 is connected, in a state of being guided by radial groove 8, to corresponding lever 9 of lever shaft 10 by way of link 14, movement of guided members 17 along radial grooves 8 in response to an external force applied thereto causes lever shaft 10 to rotate relative to drive plate 3 by an angle and in the direction corresponding to movement of guided members 17 by the action of links 14.

Further, each guided member 17 has retaining hole 18 that opens toward the forward side (the side opposite to camshaft 1). Within each retaining hole 18 is slidably disposed nearly cylindrical retainer 20 that retains ball 19 serving as an engagement portion. With each retaining hole 18 is also disposed coil spring 21 that urges retainer 20 forward. Retainer 20 has at the central portion of the front surface semispherical depression 20*a* in which ball 19 that constitutes part of guided member 17 is rotatably disposed.

Figure 10:
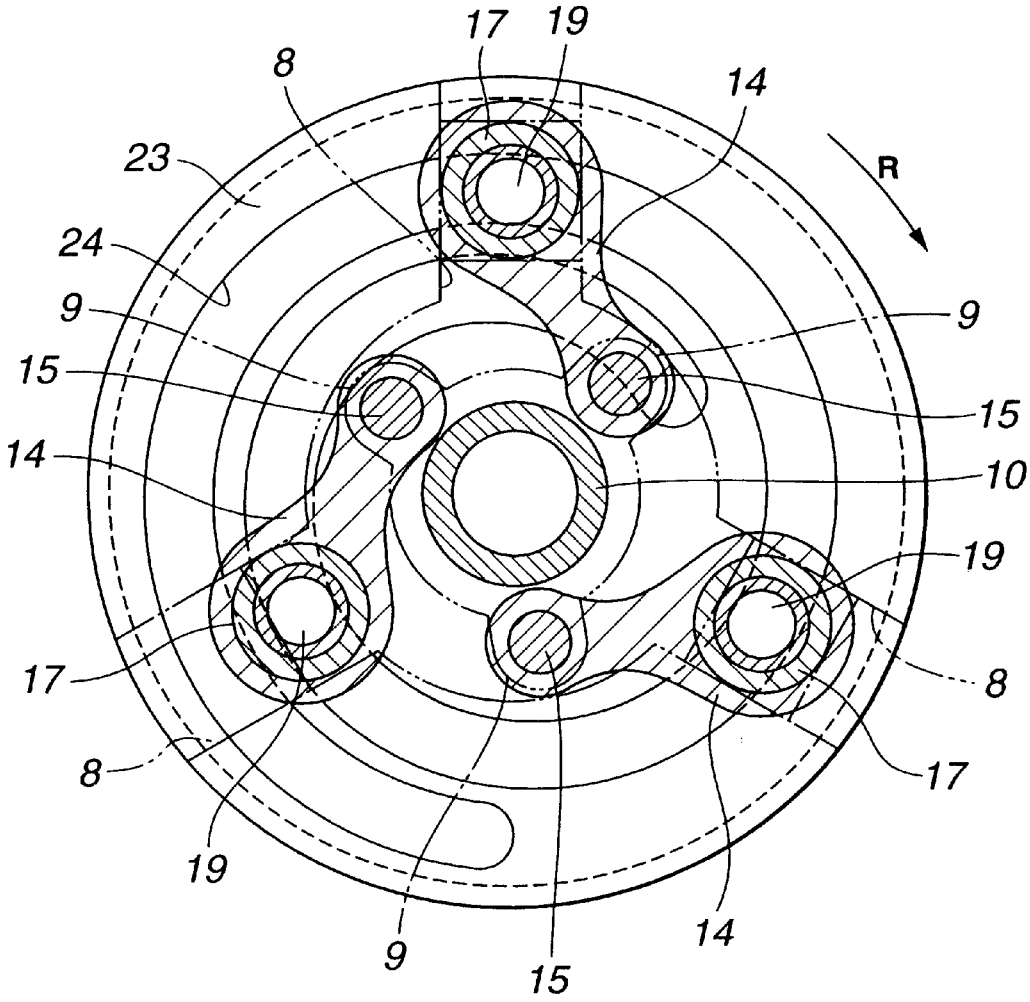
FIG. 10 is a view similar to FIG. 2 but shows the apparatus in a different operating state.
Figure 11:
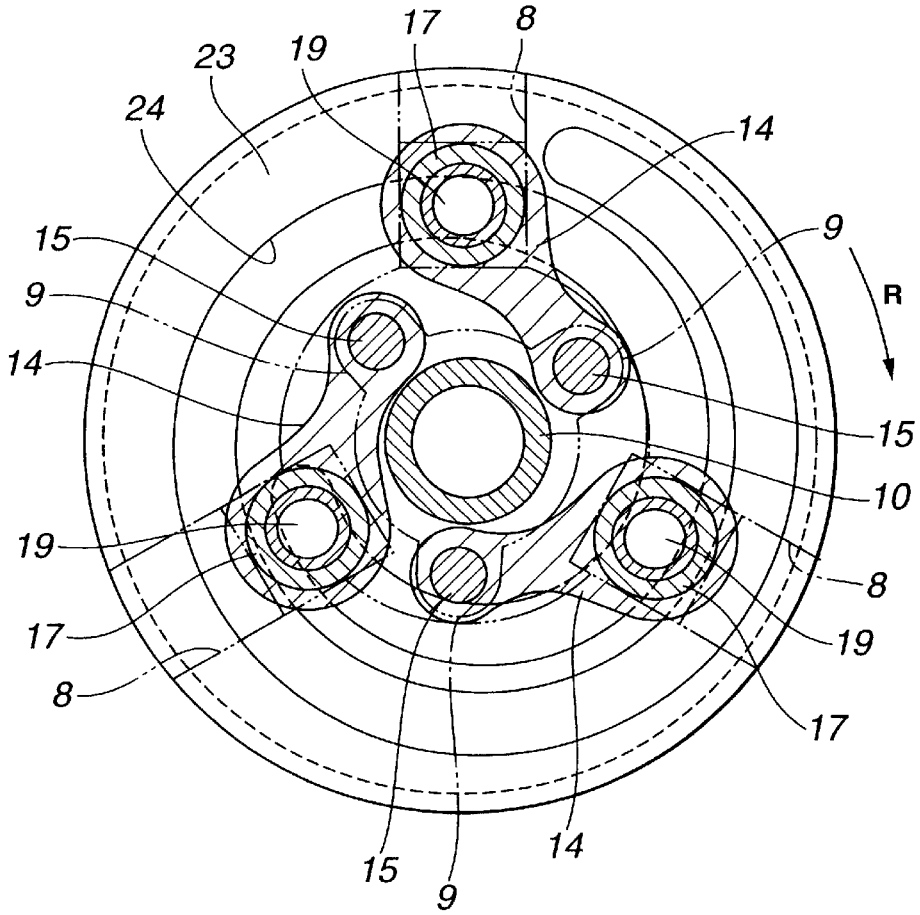
FIG. 11 is a view similar to FIG. 2 but shows the apparatus in a further different operating state.

At the position forward of levers 9, intermediate rotary member 23 in the form of a nearly circular plate is mounted on lever shaft 10 by way of ball bearing 22. Intermediate rotary member 23 has at the rear side surface thereof spiral groove (spiral guide) 24 of a semicircular cross section in which ball 19 of each guided member 17 is rollably engaged. As shown in FIGS. 10 and 11, the spiral shape of spiral groove 24 is so formed as to reduce in the spiral radius as it extends along the rotational direction R. Accordingly, when intermediate rotary member 23 rotates in the retard direction relative to drive plate 3, with balls 19 of guided members 17 being engaged in spiral groove 24, guided members 17 are moved radially inward along spiral groove 24. On the other hand, when intermediate rotary member 23 rotates in the advance direction relative to drive plate 3, guided members 17 are moved radially outward. The spiral shape of spiral groove 24 will be described in detail later.

In this embodiment, phase control mechanism 5 is constituted by above-described radial grooves 8 of drive plate 3, guided members 17, links 14, levers 9, spiral groove 24 of intermediate rotary member 23, etc. With phase control mechanism 5, when control force applying unit 4 applies to intermediate rotary member 23 a rotational control force for causing intermediate rotary member 23 to rotate relative to camshaft 1, guided members 17 are moved radially by means of spiral groove 24 and applies to drive plate 3 a rotational control force having been increased at a predetermined rate by way of links 14 and levers 9, for causing drive plate 3 to rotate relative to camshaft 1.

Figure 3:
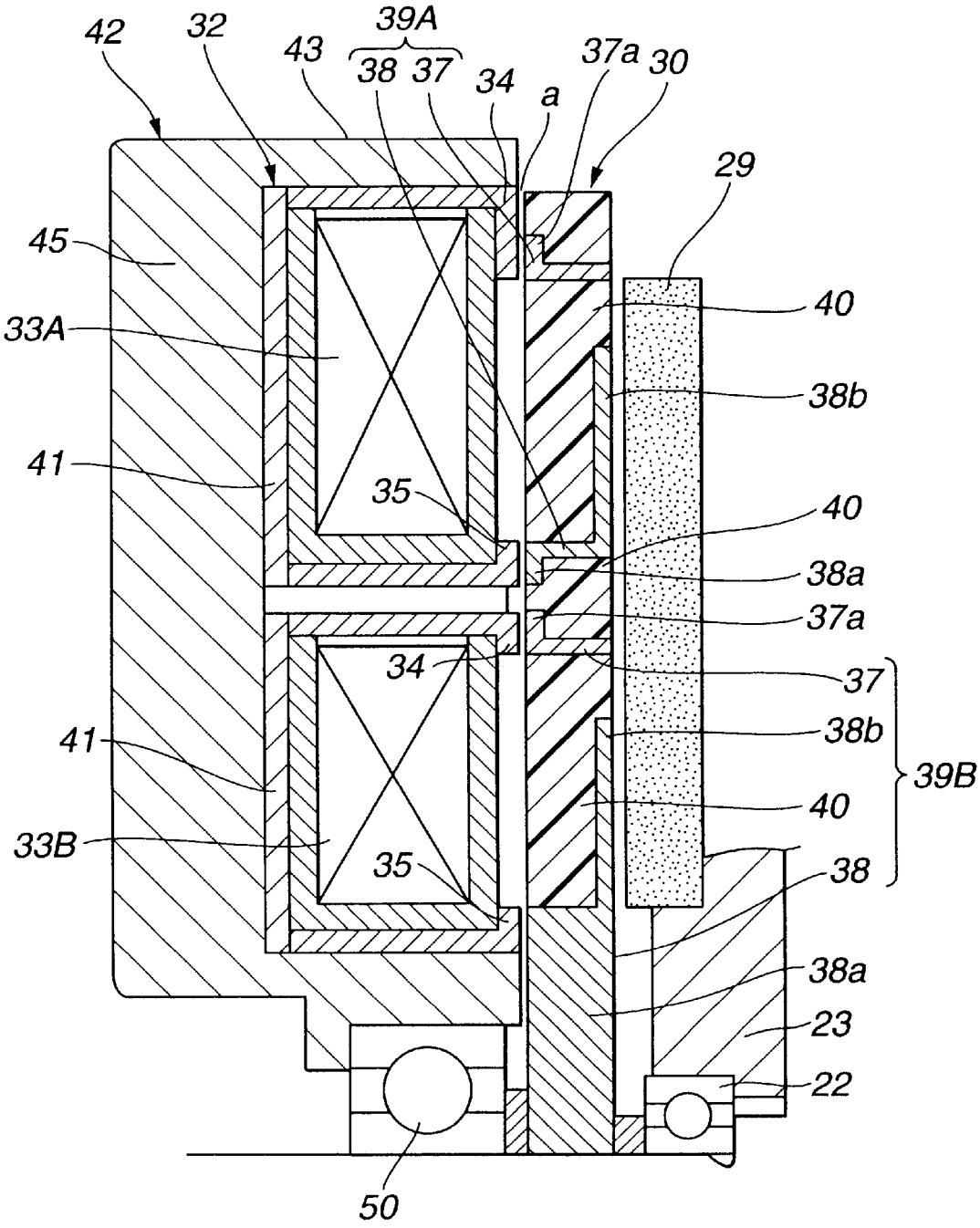
FIG. 3 is an enlarged view of a portion of FIG. 1.

On the other hand, as shown in FIGS. 1 and 3, control force applying unit 4 includes annular plate-shaped permanent magnet block 29 joined to the forward surface side (the side opposite to drive plate 3) of intermediate rotary member 23, annular plate-shaped yoke block 30 integrally connected to lever shaft 10, and electromagnetic coil block 32 disposed within and attached to cover 12. Electromagnetic coil block 32 has electromagnetic coils 33A, 33B connected to a drive circuit (not shown) including an exciting circuit, distributing circuit, etc., and the drive circuit is adapted to be controlled by a controller (not shown). In the meantime, the controller receives various input signals such as a crank angle signal, cam angle signal, engine speed signal and engine load signal and outputs a control signal based on an operating condition of an engine to the drive circuit.

Figure 4:
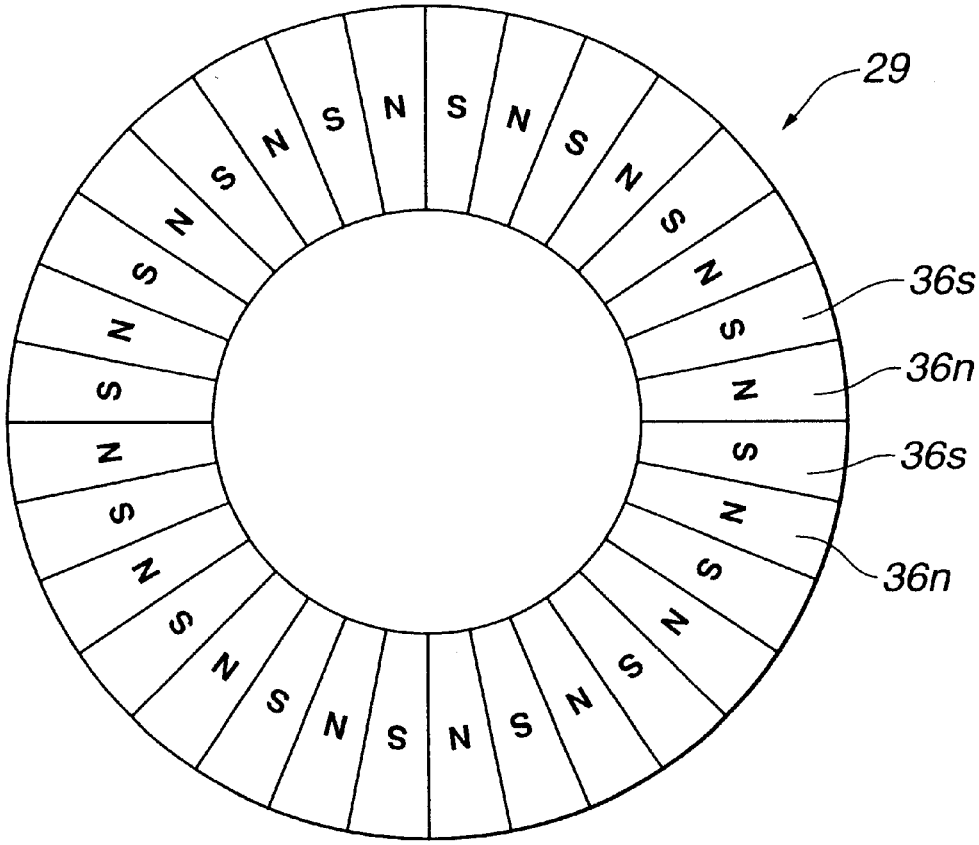
FIG. 4 is an elevational view of a permanent magnet block of the apparatus of FIG. 1.

As shown in FIG. 4, permanent magnet block 29 is magnetized so as to have on the surface to which the axial direction is perpendicular a plurality of magnetic poles (N pole, S pole) that are elongated radially and disposed so that N poles and S poles are arranged alternately in the circumferential direction. In the meantime, in FIG. 4, 36*n* indicates a magnetic pole surface of N pole and 36*s* indicates a magnetic pole surface of S pole.

Figure 5:
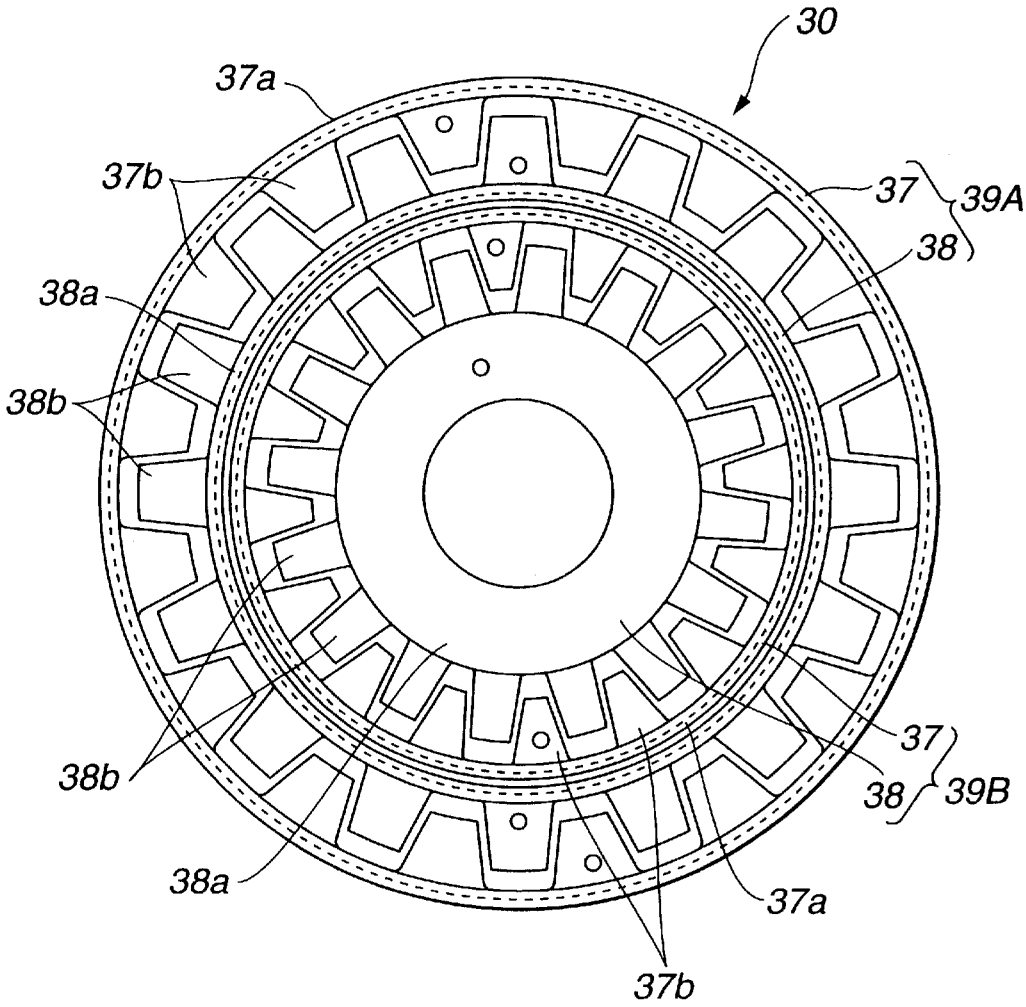
FIG. 5 is an elevational view of a yoke block of the apparatus of FIG. 1, with a resinous material filled therein being omitted.
Figure 6:
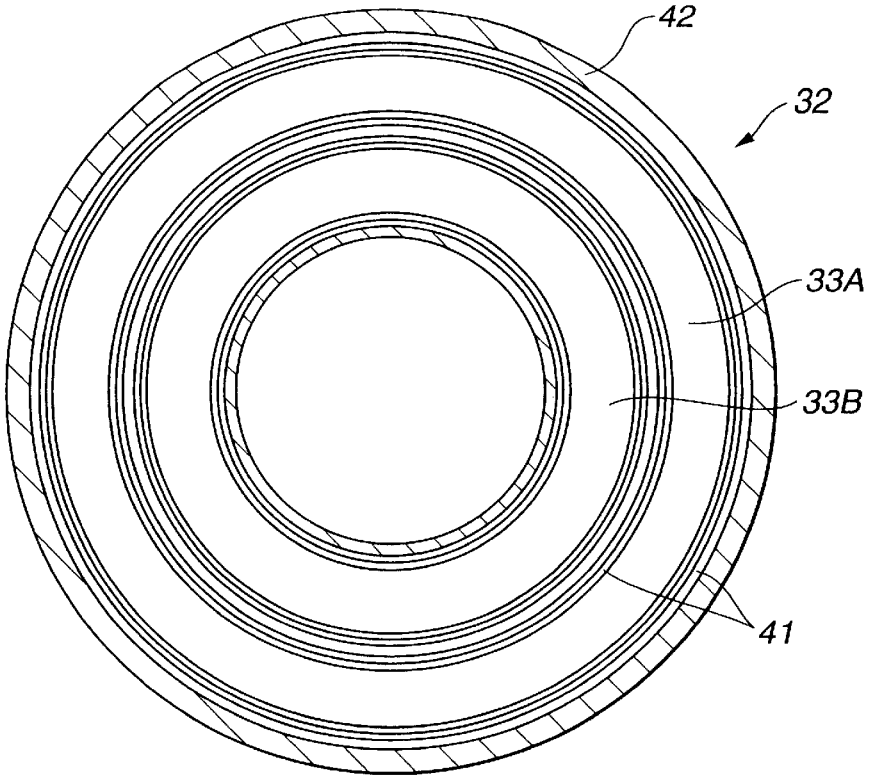
FIG. 6 is a cross sectional view of an electromagnetic coil block of the apparatus of FIG. 1.

As shown in FIGS. 3 and 5, yoke block 30 includes a pair of yokes 39A, 39B and is integrally connected at an inner circumferential thereof to lever shaft 10.

Each yoke 39A or 39B includes a pair of internally and externally toothed rings 37, 38 made of a metal of a high magnetic permeability. As shown in FIG. 5, toothed rings 37, 38 include annular, flat plate-shaped base portions 37*a*, 38*a* and a plurality of radially inward and radially outward, nearly trapezoidal teeth 37*b*, 38*b*, respectively. In this embodiment, teeth 37*b*, 38*b* of respective toothed rings 37, 38 are disposed circumferentially equidistant and so as to extend toward each other, i.e., extend inwardly and outwardly toward tops thereof. Teeth 37*b*, 38*b* of internally and externally toothed rings 37, 38 are disposed circumferentially alternately and with equal pitches and connected with each other with resinous material 40 serving as an insulator.

Two yokes 39A, 39B constituting yoke block 30 are respectively disposed radially outward and inward so as to constituting a generally circular plate and are assembled so that adjacent two of teeth 37*b*, 38*b* are circumferentially spaced from each other by ¼ pitch.

Further, as shown in FIGS. 1 and 3, yoke block 30 is disposed so as to have side surfaces that axially oppose to permanent magnet block 29 and electromagnetic coil block 32, respectively. Teeth 37*b*, 38*b* of internally and externally toothed rings 37, 38 are disposed on the permanent magnet block 29 side. On the other hand, base portions 37*a*, 38*a* are disposed on the permanent magnet block 32 side. Each toothed ring 37, 38 is thus bent at the joint between teeth 37*b*, 38*b* and base portions 37*a*, 38*a*. Similarly to the connection between toothed rings 37, 38, resinous material 40 serving as an insulator is disposed between yokes 39A, 39B so as to connect therebetween.

On the other hand, electromagnetic coil block 32 includes two electromagnetic coils 33A, 33B that are respectively disposed radially outside and inside and yoke 41 for leading magnetic flux generated at magnetic coils 33A, 33B to magnetic input and output portions 34, 35 of respective electromagnetic coils 33A, 33B.

As shown in FIG. 3, magnetic input and output portions 34, 35 of respective magnetic coils 33A, 33B are opposed to ring-shaped base portions 37*a*, 38*a* of yoke block 30 with an axial gap "a" therebetween, respectively. Accordingly, when electromagnetic coils 39A, 39B are excited to generate magnetic field in a predetermined direction, magnetic induction is caused in yokes 30A, 30*b* that are opposed to yoke block 30 with an air gap "a" therebetween, resulting in that magnetic poles corresponding to the direction of magnetic field are produced in respective toothed rings 37, 38 of yokes 39A, 39B.

The magnetic field produced by electromagnetic coils 33A, 33B is sequentially changed depending upon a predetermined pattern in response to an input of pulse to the drive circuit. This causes the magnetic poles of teeth 37*b*, 38*b* opposed to magnetic pole surfaces 36*n*, 36*s* of permanent magnet block 29 to move by ¼ pitch. Thus, intermediate rotary member 23 follows the circumferential movement of the magnetic poles on yoke block 30 and is caused to rotate relative to lever shaft 10.

Further, electromagnetic coil block 32 is covered almost in its entirety by retaining block 42 made of a non-magnetic material such as aluminium except for magnetic inlet and outlet portions 34, 35 of both yokes 41, 41 and is attached to cover 12 by way of retaining block 42. Further, at the inner circumferential surface of retaining block 42 is disposed ball bearing 50, and retaining block 42 is rotatably mounted on lever shaft 10 by way of ball bearing 50.

The spiral shape of spiral groove 24 of intermediate rotary member 23 will now be described.

Figure 7:
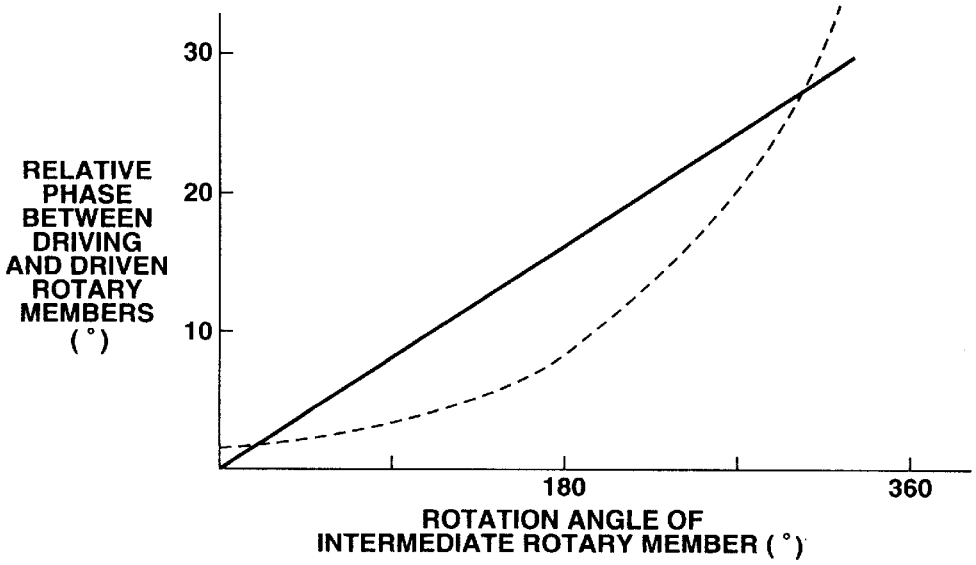
FIG. 7 is a graph of a variation characteristic of a relative phase between driving and driven rotary members in response to a variation of rotation angle of an intermediate rotary member of the apparatus of FIG. 1.

The spiral of spiral groove 24 is defined so that the variation rate of spiral radius per angle is not constant and all of three links 14 that are designed to have the same length can operate synchronously with each other without any problem, i.e., the relative phase between the driving rotary member (drive plate 3) and the driven rotary member (lever shaft 10) varies rectilinearly as represented by the solid line in FIG. 7 in response to a variation of rotation angle of intermediate rotary member 23.

The spiral of spiral groove 24 is defined specifically in the following manner.

Figure 8:
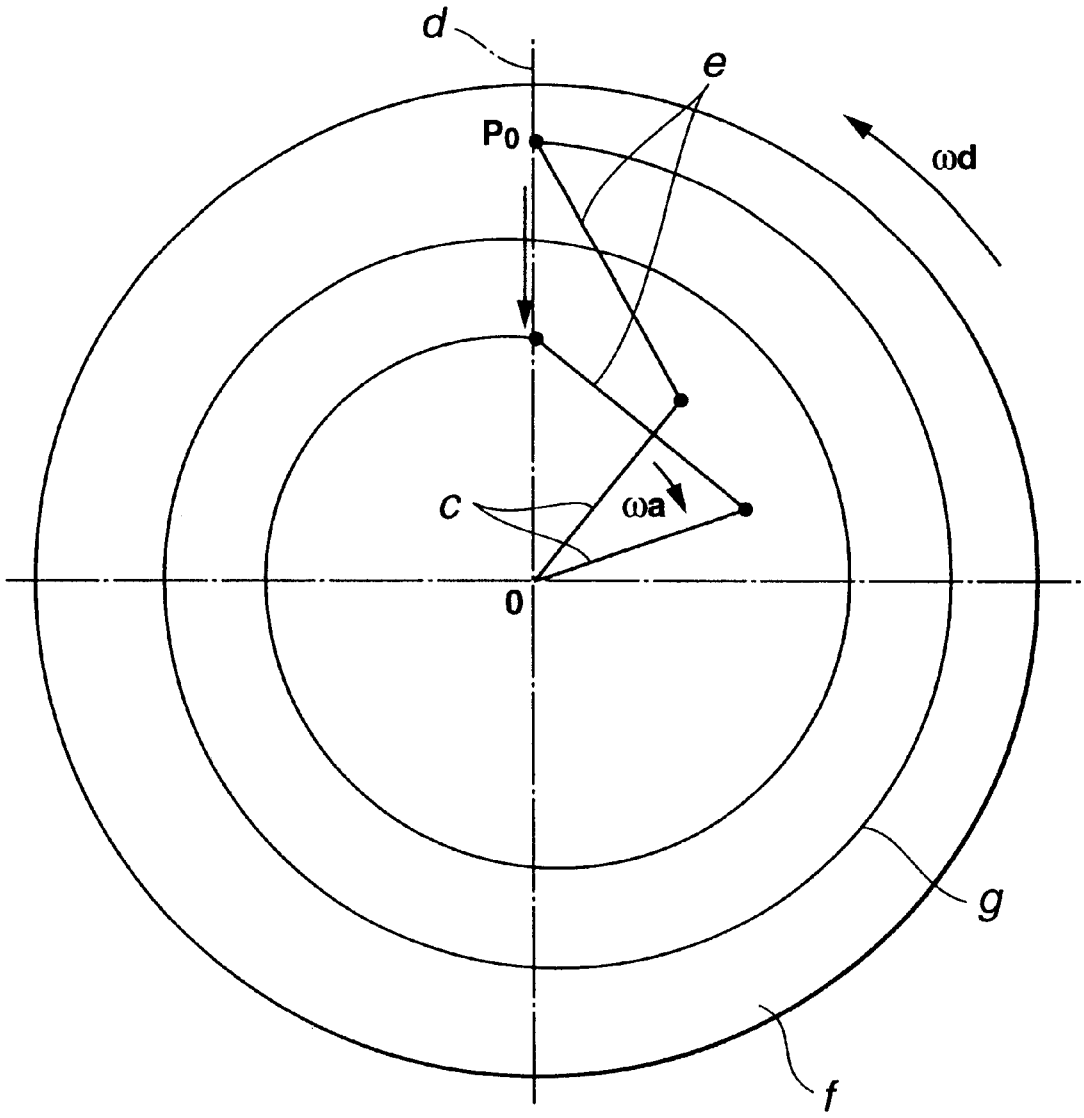
FIG. 8 is a schematic view for illustrating a spiral shape of a spiral guide employed in the apparatus of FIG. 1.

As shown in FIG. 8, when there are provided an arm c rotatable about fixed point O, straight guide line d passing through fixed point O, link e having one end pivotally connected to an end of arm c and the other end bound by guide line d so as to be slidable thereon, and disk f rotatable about fixed point O, the spiral of spiral groove 24 consists of a spiral curve generated on disk f by the other end of link e when arm c is rotated about fixed point O at angular velocity ωa and at the same time disk f is rotated at second angular velocity ωd that has an optional velocity ratio with respect to first angular velocity ωa.

Further, the spiral of this embodiment can be further strictly specified in the following manner.

Figure 9:
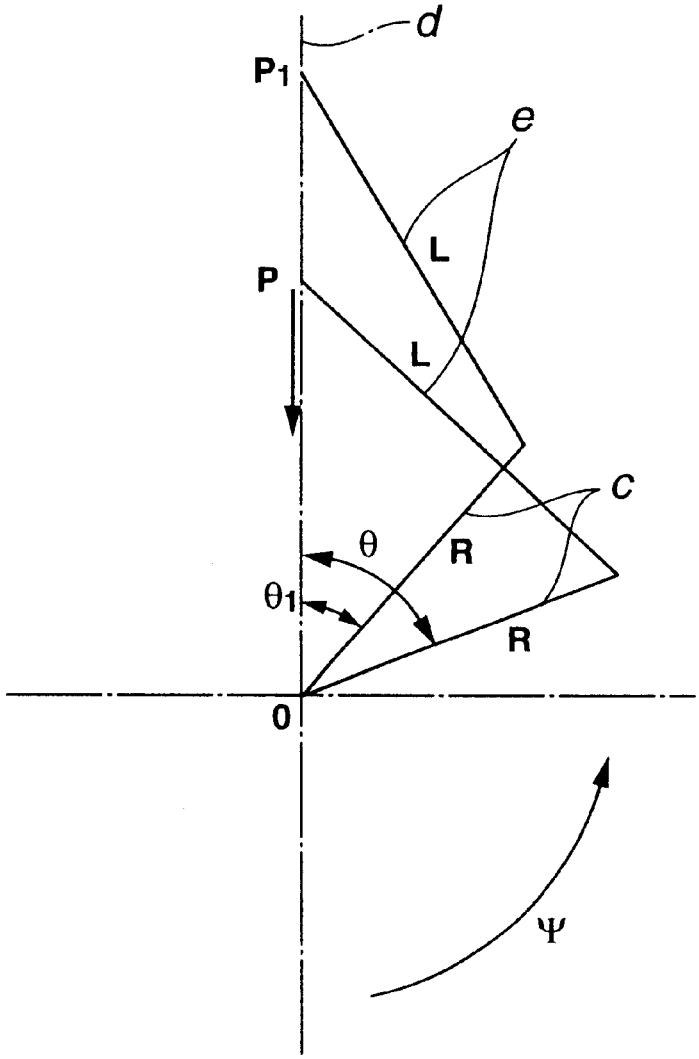
FIG. 9 is a schematic view for illustrating the spiral shape.

Namely, as shown in FIG. 9, when there are provided a spiral rotating about fixed point O, arm c rotatable about fixed point O, guide line d passing through fixed point O, and link e having one end pivotally connected an end of arm c and the other end bound by guide line d so as to be slidable thereon, the spiral satisfies the following expressions (1) and (2) or (1) and (3);

$$P = \frac{2R\cos\theta \pm \sqrt{(2R\cos\theta)^2 - 4(R^2 - L^2)}}{2} \tag{1}$$

-continued $$\theta = \frac{a}{2\pi}\psi + \cos^{-1}\left(\frac{R^2 + P_1^2 - L^2}{2RP^1}\right) \quad (2)$$

$$\theta = \frac{a}{2\pi}\psi + \cos^{-1}\left(\frac{R^2 + P_1^2 - L_2}{2RP^1}\right) \quad (3)$$

where R is the length of arm c, L is the length of link e, θ is an angle between arm c and guide lined, ψ is a rotation angle of a spiral, α is an advance angle coefficient (angular movement of arm c per one rotation of the spiral), P is a radius of pitch circle at a rotation angle ψ of the spiral, and P1 is a radius of pitch circle at an initial position of the spiral.

Herein, description will be made as to the expressions (1) and (2). The expressions (1) and (2) are obtained with the following conditions;

(A) Guide line d (radial groove 8 in the above-described embodiment) is extended radially;

(B) a linearity is established between the rotation angle ψ of the spiral and the transformation angle θ by link e; and (C) links e of equal length are used.

First, since the conversion angle $(\theta-\theta_1)$ has a linearity relationship with the rotation angle ψ of the spiral, θ is obtained from the following expression (4) by using an optional advance angle coefficient α, $$\theta_1 = \frac{a}{2\pi}\psi + \theta_1 \quad (4)$$

where $\theta_1$ is an angle between arm c and guide line d at an initial condition, and θ is an angle between arm c and guide line d at a rotation angle ψ of the spiral.

Further, if R, L, $P_1$ are determined optionally, $\theta_1$ is determined univocally and can be expressed by the following expression (5) according to cosine theorem.

$$\theta_1 = \cos^{-1}\left(\frac{R^2 + P_1^2 - L^2}{2RP_1}\right) \quad (5)$$

Accordingly, from the expressions (4) and (5), an angle θ between arm c and guide line d at a rotation angle ψ of the spiral is expressed by the above-described expression (2).

Further, pitch circle radius P at rotation angle ψ of the spiral can be expressed by the following expression (6) by using cosine theorem. From the expression (6), the expression (7) is obtained.

$$L^2=P^2+R^2-2PR\cos\theta \quad (6)$$

$$0=P^2-2R\cos\theta P+(R^2-L^2) \quad (7)$$

From the expression (7), the above-described expression (1) is obtained.

Further, in case the winding direction of the spiral is opposite, the following expression (8) is used in place of the expression (4).

$$\theta = -\frac{a}{2\pi}\psi + \theta_1 \quad (8)$$

As a result, the expression (2) is replaced by expression (3).

In the meantime, since in this embodiment three links 14 are formed so as to have equal length, radial grooves 8 (guide line d in FIG. 9) or levers 9 (arm c in FIG. 9) are circumferentially unequally arranged. Herein, though a concrete conditional expression or the like is not shown, such an arrangement is univocally obtained by optionally determining the angle between an adjacent pair of radial grooves 8 or the like if the spiral shape of spiral groove 24 has been defined.

Figure 2:
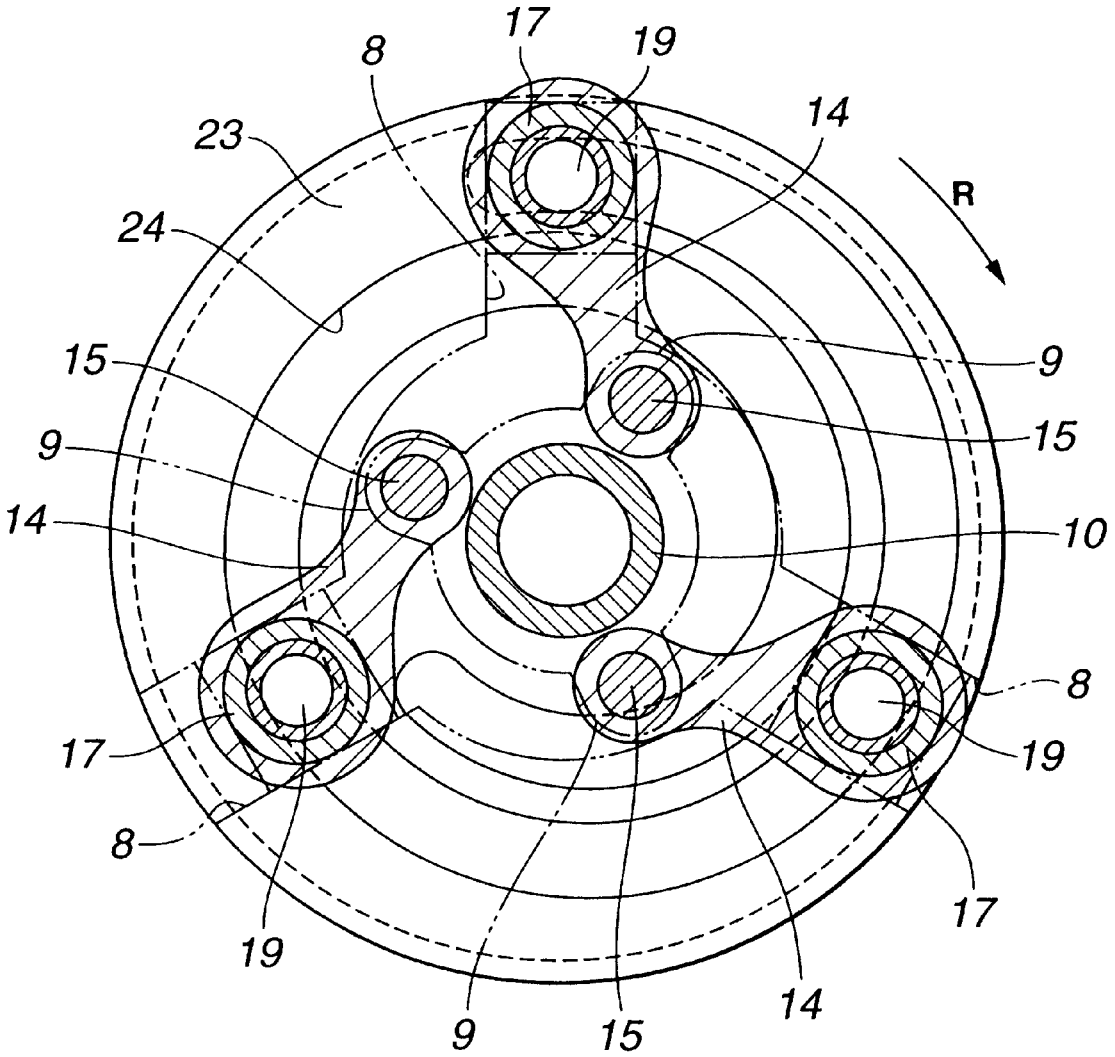
FIG. 2 is a sectional view taken along the line II—II of FIG. 1.

The valve timing control apparatus structured as above can attain stable engine revolution and an improved fuel consumption by previously holding the relative phase between drive plate 3 and lever shaft 10 at the most retarded condition as shown in FIG. 2 at start of the internal combustion engine or at idling and thereby holding the relative phase between crankshaft 11 and camshaft 1 (the opening and closing timing of engine valve) at the most retarded condition.

When from this condition, the operation of the engine proceeds to a normal operation and an instruction for changing the relative phase between crankshaft 11 and camshaft 1 to a most advanced side value is outputted from the controller (not shown) and inputted to the drive circuit (not show) of electromagnetic coil block 32, electromagnetic coil block 32 changes a generated magnetic field depending upon a predetermined pattern in response to the instruction thereby causing permanent magnet block 20 to relatively rotate together with intermediate rotary member 23 toward the retard side maximumly. By this, guided members 17 that are engaged with spiral groove 24 by way of balls 19 are caused to move radially inward maximumly along grooves 8 as shown in FIGS. 10 and 11 in sequence thereby causing the relative phase between drive plate 3 and lever shaft 10 to be changed maximumly toward the retard side by way of links 14 and levers 9. As a result, the relative phase between crankshaft 11 and camshaft 1 is changed toward the maximumly retarded condition, thus making it possible to attain a high output of the engine.

Further, when from this condition an instruction for changing the relative phase between crankshaft 11 and camshaft 1 maximumly toward the retard side is outputted from the controller, electromagnetic coil block 23 changes a magnetic field to be generated after a reverse pattern thereby causing intermediate rotary member 23 to relatively rotate maximumly toward the advance side and causing guided members 17 engaged with spiral groove 24 to move radially outward maximumly along radial grooves 8 as shown in FIG. 2. By this, guided members 17 causes drive plate 3 and lever shaft 10 to move relative to each other maximumly by way of links 14 and levers 9 thereby causing the relative phase between crankshaft 11 and camshaft 1 to be changed toward the maximumly retarded condition.

With the valve timing control apparatus of this embodiment, three links 14 can be equal in length and can operate synchronously with each other under the condition of all being engaged with single spiral groove 24 (by way of balls 19) by defining the spiral shape of spiral groove 24 in the manner described as above. Accordingly, since links 14 of the same size and same shape can be used, manufacture and design of links 14 and assembly thereof can be attained with ease. Further, since links 14 are engaged with single spiral groove 24, the inclination formed by the spiral can be more gentle for thereby solving the problem that intermediate rotary member 23 is unexpectedly rotated by the input of torque from the camshaft 1 side.

Further, with the system of this embodiment, the spiral shape of spiral groove 24 is designed so that the phase angle between drive plate 3 and lever shaft 10 changes rectilinearly with the progress of rotation of intermediate rotary member 23. This makes it possible for drive plate 3 and lever shaft 10 to operate stably at constant speed when intermediate rotary member 23 is rotated at constant speed.

In the meantime, while the spiral shape of spiral groove 24 has been described and shown with respect to the case the phase angle between drive plate 3 and lever shaft 10 changes rectilinearly with the progress of rotation of intermediate rotary member 23, another spiral shape can be employed, provided that the variation rate of spiral radius per angle is not constant.

Figure 12:
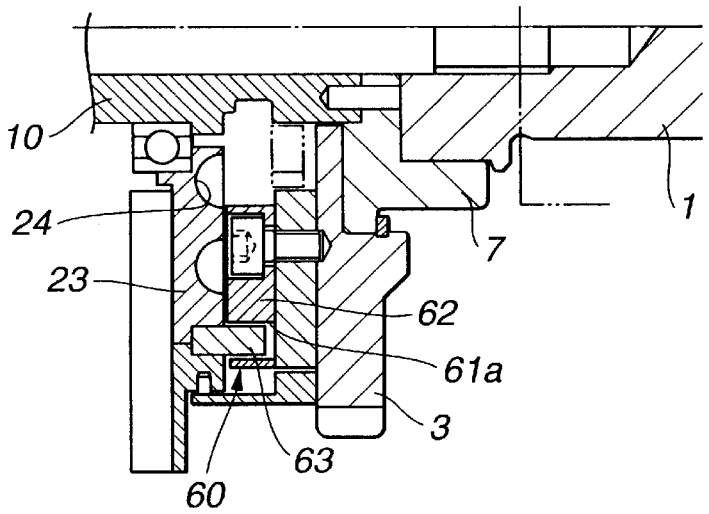
FIG. 12 is a fragmentary sectional view of a valve timing control apparatus according to another embodiment of the present invention.
Figure 13:
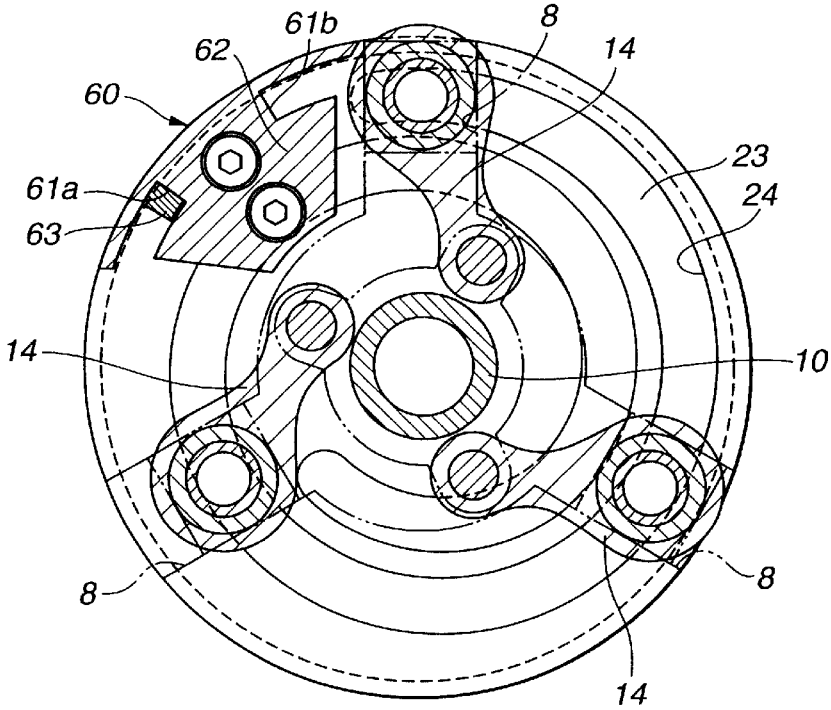
FIG. 13 is a view similar to FIG. 2 buts shows an operating state of the apparatus of FIG. 12.
Figure 14:
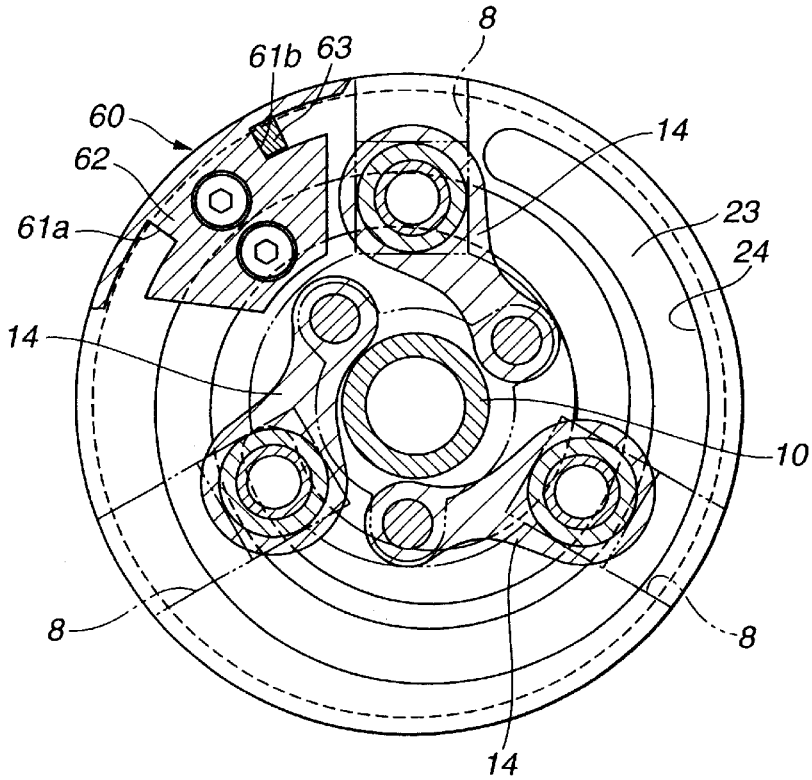
FIG. 14 is a view similar to FIG. 13 but shows a different operating state.

FIGS. 12 to 14 show another embodiment of the present invention.

The basic structure of this invention is substantially the same as the previous embodiment shown in FIGS. 1 to 11 but differs in the setting of the spiral shape of spiral groove 24 and the provision of stopper 60 for restricting rotation of intermediate rotary member 23. Hereinafter, the present invention will be described with reference to FIGS. 12 to 14 in which like parts and portions to those of the previous embodiment of FIGS. 1 to 11 are designated by like reference characters and repeated description thereto is omitted for brevity.

First, the spiral shape of spiral groove 24 is defined so that intermediate rotary member 23 is returned to an initial position (e.g., the position for causing an intake side valve train to the most retarded side condition) suited for start of an internal combustion engine by a torque variation on the camshaft 1 side due to the profile of a drive cam and a spring force of valve spring.

To the outer circumferential portion front surface side of drive plate 3 is attached engagement plate 62 having on the circumferentially opposite sides thereof recessed engagement portions 61*a*, 61*b*. To the rear surface side of intermediate rotary member 23 is provided stopper projection 63 that is abuttingly engageable with abutment portions 61*a*, 61*b*. Stopper projection 63 and engagement plate 62 constitute stopper 60 for restricting rotation of intermediate rotary member 23.

In this embodiment, at the time of engine stall, intermediate rotary member 23 is naturally returned to an initial position suited for start of the engine by a torque variation before stoppage of rotation of camshaft 1 and causes stopper projection 63 to abut upon one engagement portion 61*a* as shown in FIG. 13, thus making it assured for intermediate rotary member 23 to stop accurately at the initial position. Accordingly, at restart of an internal combustion engine, it becomes possible to start the engine assuredly at optimum valve timing. In the meantime, as shown in FIG. 14, stopper projection 63 can abut upon the other engagement portion 61*b* when intermediate rotary member 23 is rotated reversely, thus making it possible to prevent excessive reverse rotation of intermediate rotary member 23.

From the foregoing, it will be understood that according to the present invention the variation characteristic of the relative phase between the driving rotary member and the driven rotary member with respect to rotation of the intermediate rotary member can be set optionally depending upon the spiral shape of the spiral guide, and therefore design restrictions of the links engaged with the spiral guide and other parts and restrictions caused at the time of improvement in the performance characteristics of the system caused by the spiral shape can be reduced.

The entire contents of Japanese Patent Application P2001-313368 (filed Oct. 11, 2001) are incorporated herein by reference.

Although the invention has been described as above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A valve timing control apparatus for an internal combustion engine comprising:

a driving rotary member drivingly connected to a crankshaft;

a driven rotary member drivingly connected to a camshaft;

a plurality of radial guides provided to one of the driving rotary member and the driven rotary member;

an intermediate rotary member rotatable relative to the driving rotary member and the driven rotary member and having at a side thereof a spiral guide of a single spiral;

a plurality of guided members movably engaged with the respective radial guides and the spiral guide;

a plurality of links connecting between the other of the driving rotary member and the driven rotary member and the respective guided members;

a control force applying unit for applying to the intermediate rotary member a control force for rotating the intermediate rotary member to rotate relative to the driving rotary member and the driven rotary member;

wherein rotation of the intermediate rotary member caused by the control force applying unit causes radial movement of the guided members which is in turn converted to relative rotation between the driving rotary member and the driven rotary member by the links; and wherein the spiral of the spiral guide is defined so that a variation rate of spiral radius per angle is not constant.

2. A valve timing control apparatus according to claim 1, wherein the links have equal length and the spiral of the spiral guide is defined so that the links can operate synchronously with each other.

3. A valve timing control apparatus according to claim 1, wherein the spiral of the spiral guide is defined so that a relative phase between the driving rotary member and the driven rotary member changes rectilinearly with the progress of rotation angle of the intermediate rotary member.

4. A valve timing control apparatus according to claim 2, wherein when there are provided an arm rotatable about a fixed point, a straight guide line passing through the fixed point, a link having one end pivotally connected to an end of the arm and the other end bound by the guide line so as to be slidable thereon, and a disk rotatable about the fixed point, the spiral of the spiral guide comprises a spiral curve generated on the disk by the other end of the link when the arm is rotated about the fixed point at a first angular velocity and at the same time the disk is rotated at a second angular velocity that has an optional velocity ratio with respect to the first angular velocity.

5. A valve timing control apparatus according to claim 2, wherein when there are provided a spiral rotating about a fixed point, an arm rotatable about the fixed point, a guide line passing through the fixed point, and a link having one end pivotally connected to an end of the arm and the other end bound by the guide line so as to be slidable thereon, the spiral of the spiral guide comprises a spiral curve that satisfies the following expressions (1) and (2) or (1) and (3);

$$P = \frac{2R\cos\theta \pm \sqrt{(2R\cos\theta)^2 - 4(R^2 - L^2)}}{2} \quad (1)$$

$$\theta = \frac{a}{2\pi}\psi + \cos^{-1}\left(\frac{R^2 + P_1^2 - L^2}{2RP_1}\right) \quad (2)$$

$$\theta = \frac{a}{2\pi}\psi + \cos^{-1}\left(\frac{R^2 + P_1^2 - L_2}{2RP_1}\right) \quad (3)$$

where R is the length of arm c, L is the length of link e, θ is an angle between arm c and guide line d, ψ is a rotation angle of the spiral, α is an advance angle coefficient (angular movement of arm c per one rotation of the spiral), P is a radius of pitch circle at a rotation angle ψ of the spiral, and P1 is a radius of pitch circle at an initial position of the spiral.

6. A valve timing control apparatus according to claim 1, wherein the spiral of the spiral guide is defined so that the intermediate rotary member is returned to an initial position suited for start of the internal combustion engine by a torque variation on the camshaft side.

7. A valve timing control apparatus according to claim 6, further comprising a stopper for preventing further rotation of the intermediate rotary member when the intermediate rotary member returns to the initial position.

8. A valve timing control apparatus for an internal combustion engine comprising:

a driving rotary member;

a driven rotary member; and means for controlling a relative phase between the driving rotary member and the driven rotary member;

said means comprising an intermediate rotary member disposed between the driving rotary member and the driven rotary member, a spiral guide of a single spiral at one side of the intermediate rotary member, a plurality of radial guides provided to one of the driving rotary member and the driven rotary member, a plurality of guided members engaged with the respective radial guides and the spiral guide, and a plurality of links connecting between the other of the driving rotary member and the driven rotary member and the respective guided members such that rotation of the intermediate rotary member is converted to relative rotation of the driving rotary member and the driven rotary member;

wherein the spiral of the spiral guide is defined so that a variation rate of spiral radius per angle is not constant.

9. A valve timing control apparatus according to claim 8, wherein the links have equal length and the spiral of the spiral guide is defined so that the links can operate synchronously with each other.

10. A valve timing control apparatus according to claim 8, wherein the spiral of the spiral guide is defined so that a relative phase between the driving rotary member and the driven rotary member changes rectilinearly with the progress of rotation angle of the intermediate rotary member.

11. A valve timing control apparatus according to claim 9, wherein when there are provided an arm rotatable about a fixed point, a straight guide line passing through the fixed point, a link having one end pivotally connected to an end of the arm and the other end bound by the guide line so as to be slidable thereon, and a disk rotatable about the fixed point, the spiral of the spiral guide comprises a spiral curve generated on the disk by the other end of the link when the arm is rotated about the fixed point at a first angular velocity and at the same time the disk is rotated at a second angular velocity that has an optional velocity ratio with respect to the first angular velocity.

12. A valve timing control apparatus according to claim 9, wherein when there are provided a spiral rotating about a fixed point, an arm rotatable about the fixed point, a guide line passing through the fixed point, and a link having one end pivotally connected to an end of the arm and the other end bound by the guide line so as to be slidable thereon, the spiral of the spiral guide comprises a spiral curve that satisfies the following expressions (1) and (2) or (1) and (3);

$$P = \frac{2R\cos\theta \pm \sqrt{(2R\cos\theta)^2 - 4(R^2 - L^2)}}{2} \quad (1)$$

$$\theta = \frac{a}{2\pi}\psi + \cos^{-1}\left(\frac{R^2 + P_1^2 - L^2}{2RP_1}\right) \quad (2)$$

$$\theta = \frac{a}{2\pi}\psi + \cos^{-1}\left(\frac{R^2 + P_1^2 - L_2}{2RP_1}\right) \quad (3)$$

where R is the length of arm c, L is the length of link e, θ is an angle between arm c and guide line d, ψ is a rotation angle of the spiral, α is an advance angle coefficient (angular movement of arm c per one rotation of the spiral), P is a radius of pitch circle at a rotation angle ψ of the spiral, and P1 is a radius of pitch circle at an initial position of the spiral.

13. A valve timing control apparatus according to claim 8, wherein the spiral of the spiral guide is defined so that the intermediate rotary member is returned to an initial position suited for start of the internal combustion engine by a torque variation on the camshaft side.

14. A valve timing control apparatus according to claim 13, further comprising a stopper for preventing further rotation of the intermediate rotary member when the intermediate rotary member returns to the initial position.

* * * * *